US007950533B2

(12) United States Patent
Adams et al.

(10) Patent No.: US 7,950,533 B2
(45) Date of Patent: May 31, 2011

(54) MUFFLER PIPE RACK AND HANGER SYSTEM

(75) Inventors: Kirk Adams, Torrance, CA (US); Thomas Tolmasoff, Redondo Beach, CA (US)

(73) Assignee: Honda Motor Co., Ltd., Tokyo (JP)

( * ) Notice: Subject to any disclaimer, the term of this patent is extended or adjusted under 35 U.S.C. 154(b) by 846 days.

(21) Appl. No.: 11/627,325

(22) Filed: Jan. 25, 2007

(65) Prior Publication Data

US 2007/0246434 A1 Oct. 25, 2007

Related U.S. Application Data

(60) Provisional application No. 60/764,938, filed on Feb. 3, 2006.

(51) Int. Cl.
*A47F 1/04* (2006.01)

(52) U.S. Cl. ..... 211/60.1; 211/94.01; 211/113; 248/58; 248/340

(58) Field of Classification Search ..... 211/60.1, 211/70.1, 113, 118, 70.6, 94.01, 124; 248/58, 248/62, 317, 322, 339, 340; 181/227, 228
See application file for complete search history.

(56) References Cited

U.S. PATENT DOCUMENTS 2,327,379 A * 8/1943 Thomas ..... 211/74
2,370,455 A * 2/1945 Eng ..... 211/41.11
2,600,096 A * 6/1952 Cooper et al. ..... 211/41.2
2,903,138 A 9/1959 Brown
2,951,672 A 9/1960 Bott
3,243,220 A * 3/1966 Karas ..... 294/87.28
3,292,731 A 12/1966 Ballard
3,565,240 A * 2/1971 Nearman ..... 198/682
3,891,176 A 6/1975 Downing et al.
3,981,471 A * 9/1976 Currier ..... 248/317
4,367,818 A * 1/1983 Suttles ..... 211/59.2
4,401,221 A * 8/1983 Suttles ..... 211/59.2
4,549,665 A 10/1985 Smitley
4,905,949 A 3/1990 Cosgrove
5,209,358 A * 5/1993 Simard ..... 211/74
5,586,665 A * 12/1996 Brousseau ..... 211/59.2
(Continued)

OTHER PUBLICATIONS

International Search Report for PCT Application No. PCT/US07/02846, International Filing Date, Feb. 2, 2007. Search Report mailed Dec. 14, 2007.

*Primary Examiner* — Korie Chan
(74) *Attorney, Agent, or Firm* — McDermott Will & Emery LLP

(57) ABSTRACT

A muffler pipe storage rack may include an elongated support member having two ends and a longitudinal slot between the two ends. The longitudinal slot may have a width that is wider than the outer diameter of the widest of the tubular portions, but narrower than the width of the narrowest of the flanges. The longitudinal slot may have a length that is longer than the sum of the widths of all of the flanges. A first mounting bracket may be affixed to one end of the elongated support member and configured to clamp to a first substantially horizontal support and to suspend the one end of the elongated support member from the first substantially horizontal support. A second mounting bracket may be affixed to the other end of the elongated support member and configured to clamp to a second substantially horizontal support substantially parallel to the first substantially horizontal support and to suspend the other end of the elongated support member from the second substantially horizontal support.

15 Claims, 5 Drawing Sheets

U.S. PATENT DOCUMENTS 5,695,074 A 12/1997 Wiese
5,706,958 A 1/1998 Spamer
5,718,341 A 2/1998 Robertson
5,722,557 A * 3/1998 Smith ..... 220/476
5,755,341 A 5/1998 Spamer
5,779,068 A 7/1998 Whiten et al.
5,865,326 A 2/1999 Spamer
5,878,894 A 3/1999 Robertson
6,006,928 A * 12/1999 Parker ..... 211/60.1
6,059,125 A 5/2000 Parham
6,145,678 A * 11/2000 Morrison ..... 211/113
6,189,734 B1 2/2001 Apps et al.
6,360,901 B1 * 3/2002 Parham ..... 211/59.2
D459,123 S * 6/2002 Meigs ..... D6/513
6,523,719 B2 * 2/2003 Trulaske, Sr. ..... 221/301
6,631,812 B2 10/2003 Ruiz
6,739,463 B2 5/2004 Wishart et al.
2002/0166827 A1 11/2002 Robolin

* cited by examiner

MUFFLER PIPE RACK AND HANGER SYSTEM

CROSS-REFERENCE TO RELATED APPLICATION(S)

This application is based upon and claims priority to U.S. Provisional Patent Application Ser. No. 60/764,938, entitled "Muffler Pipe Hanger Rack," filed Feb. 3, 2006. The entire content of this application is incorporated herein by reference.

BACKGROUND

1. Field

This application relates to storage devices, systems and methods for muffler pipes.

2. Description of Related Art

Muffler pipes come in various sizes, and shapes. A wide variety can be challenging to store in a small area. It can also be difficult to locate and remove one of them from a large variety that are being stored. The storage and removal process can also be hazardous.

U.S. Pat. No. 2,951,672, entitled "Pipe Holder for End of Pipe," discloses the use of hooks to hang muffler pipes on a cable. This approach, however, can be cumbersome to use, may result in the hanging muffler pipes being crooked, thus occupying additional space, and requires an inventory of hooks to be manufactured, manipulated and inventoried. A variant of this hooking arrangement is disclosed in U.S. Pat. No. 3,891,176 to Downing et al.

SUMMARY

A muffler pipe storage rack may be configured to hang a plurality of muffler pipes. Each muffler pipe may include a tubular portion and a flange attached to one end of the tubular portion that is configured to be bolted to an engine manifold. The muffler pipe storage rack may include an elongated support member having two ends and a longitudinal slot between the two ends. The longitudinal slot may have a width that is wider than the outer diameter of the widest of the tubular portions, but narrower than the width of the narrowest of the flanges. The longitudinal slot may have a length that is longer than the sum of the widths of all of the flanges. A first mounting bracket may be affixed to one end of the elongated support member and configured to damp to a first substantially horizontal support and to suspend the one end of the elongated support member from the first substantially horizontal support. A second mounting bracket may be affixed to the other end of the elongated support member and configured to clamp to a second substantially horizontal support substantially parallel to the first substantially horizontal support and to suspend the other end of the elongated support member from the second substantially horizontal support.

The first mounting bracket may include an inverted U-shaped portion having an interior width that is substantially the same as the width of the first substantially horizontal support. The second mounting bracket may include an inverted U-shaped portion having an interior width that is substantially the same as the width of the second substantially horizontal support.

Each of the inverted U-shaped portions may form an open hook-like structure. Each of the open-hook like structures may be facing outwardly from the elongated support member.

The first mounting bracket may include a first releasable locking mechanism configured to releasably lock the first mounting bracket to the first substantially horizontal member. The second mounting bracket may include a second releasable locking mechanism configured to releasably lock the second mounting bracket to the second substantially horizontal member.

The first and the second locking mechanism may each include a set screw.

The elongated support member may include two elongated L-shaped members held in a spaced-apart and substantially parallel relationship by the first mounting bracket and the second mounting bracket.

There may be a clearance above the entire length of the slot that has a width that is at least as wide as the widest of the flanges.

The clearance above the entire length of the slot may have a height that is at least as tall as the thickest of the flanges.

The slot may extend through at least one of the ends of the elongated support member.

The first mounting bracket may be configured to suspend the elongated support member from the first substantially horizontal support such that the slot is not blocked by the first substantially horizontal support.

A muffler pipe hanger system may be configured to hang a plurality of muffler pipes. Each muffler pipe may include a tubular portion and a flange attached to one end of the tubular portion that is configured to be bolted to an engine manifold. The muffler pipe hanger system may include a pallet storage rack having two substantially horizontal supports substantially parallel to one another. The muffler pipe hanger system may include a plurality of substantially parallel and spaced apart elongated support members, each attached transversely to the two substantially horizontal supports and having a longitudinal slot. The longitudinal slot may have a width that is wider than the outer diameter of the widest of the tubular portions, but narrower than the width of the narrowest of the flanges. The longitudinal slot may have a length that is longer than the sum of the widths of all of the flanges.

The plurality of elongated support members may include a first, second, and third sequentially-positioned elongated support member, the first and second of which are spaced apart by an amount that is different than the spacing between the second and the third.

Each of the elongated support members may be releasably attached to the horizontal supports.

A set screw may be in each of the elongated support members oriented to effectuate the releasable attachment.

A muffler pipe hanging process may be configured to hang a muffler pipe. The muffler pipe may include a tubular portion and a flange attached to one end of the tubular portion that is configured to be bolted to an engine manifold. The muffler pipe hanging process may include positioning the muffler pipe such that the tubular portion is substantially vertical with the flange on top, moving the muffler pipe in a substantially horizontal direction while sliding it into a slot with the flange positioned above the slot, and allowing the flange of the muffler pipe to engage the slot by releasing the muffler pipe while in the slot.

The muffler pipe hanging process may include sliding one or more additional muffler pipes in the slot by repeating each of the steps of the process.

All of the mufflers pipes that are slid into the slot may be of substantially the same size and configuration. The process may include sliding one or more additional muffler pipes of a different size or configuration in a second slot different from the first slot by repeating each of the steps of the process with respect to the additional muffler pipes.

A muffler pipe removal process may be configured to remove a muffler pipe from storage. The muffler pipe may include a tubular portion and a flange attached to one end of the tubular portion that is configured to be bolted to an engine manifold. The muffler pipe removal process may include sliding the muffler pipe out of a slot by moving it in a substantially horizontal direction until it disengages from the slot, and moving the muffler pipe to a different location while disengaged from the slot.

A muffler pipe hanger system construction process may include attaching a first elongated support member transversely to a set of substantially horizontal and parallel supports, attaching a second elongated support member transversely to the substantially horizontal and parallel supports at a spacing from the first elongated support member that is based on the amount of space that is needed for a first set of muffler pipes to be hung on the first elongated support member and a second set of muffler pipes to be hung on the second elongated support members without touching the first set of muffler pipes, and attaching a third elongated support member transversely to the substantially horizontal and parallel supports at a spacing from the second member that is different than the spacing between the first and second elongated support members and that is based on the amount of space that is needed for a third set of muffler pipes to be hung on the third elongated support member without touching the second set of muffler pipes.

The muffler pipe hanger system construction process may include releasably locking the first, second and third support members to the substantially horizontal and parallel supports while spaced apart as set forth.

The releasably locking may include rotating a set screw positioned within each of the support members.

These, as well as other components, steps, features, objects, benefits, and advantages, will now become clear from a review of the following detailed description of illustrative embodiments, the accompanying drawings, and the claims.

BRIEF DESCRIPTION OF DRAWINGS

The drawings disclose illustrative embodiments. They do not set forth all embodiments. Other embodiments may be used in addition or instead. Details that may be apparent or unnecessary may be omitted to save space or for more effective illustration. When the same numeral appears in different drawings, it is intended to refer to the same or like components or steps.

DETAILED DESCRIPTION OF ILLUSTRATIVE EMBODIMENTS

Illustrative embodiments are now discussed. Other embodiments may be used in addition or instead. Details that may be apparent or unnecessary may be omitted to save space or for a more effective presentation.

Figure 1:
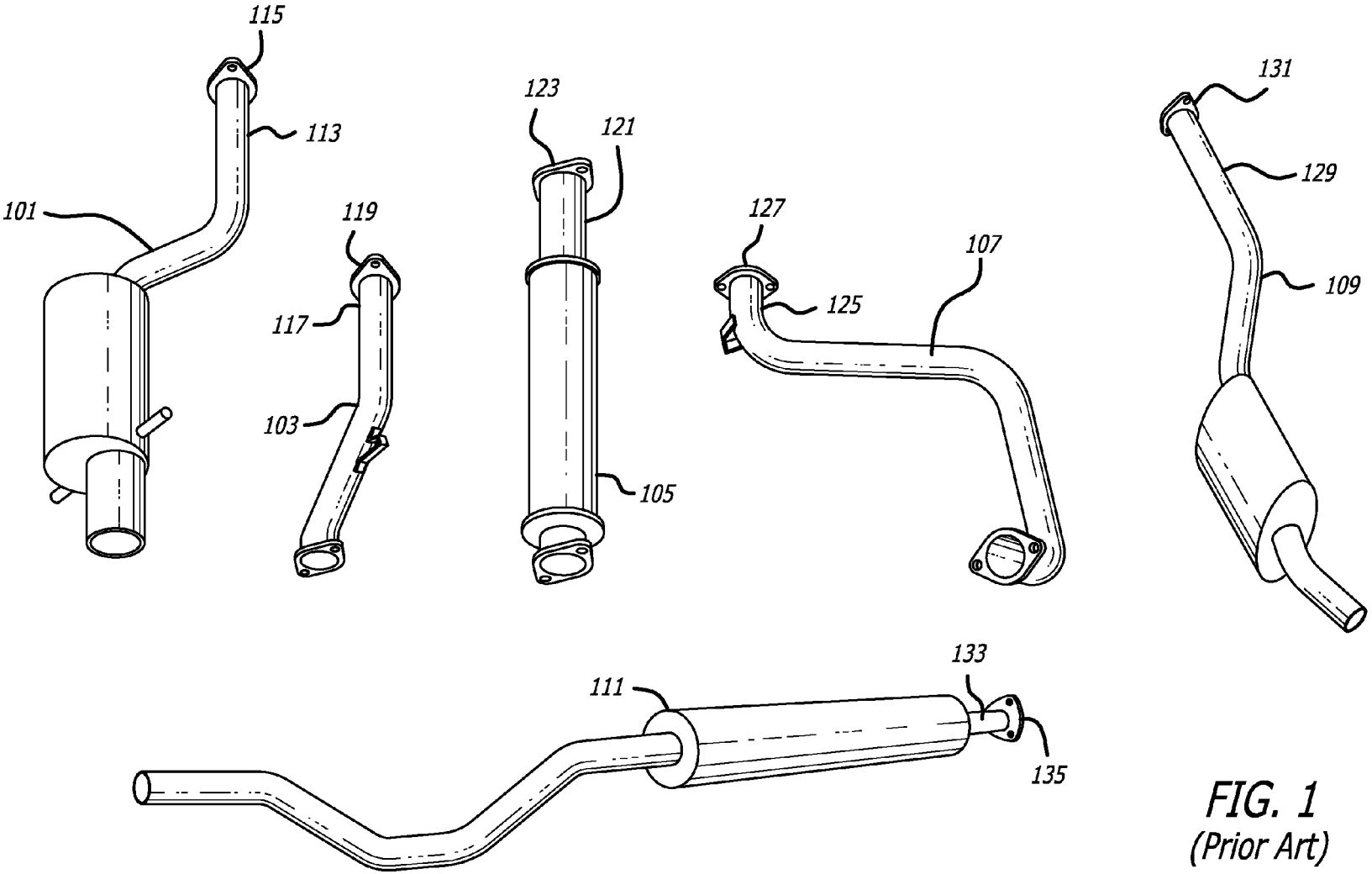
FIG. 1 (Prior Art)
FIG. 1 illustrates various muffler pipes.

FIG. 1 illustrates various muffler pipes. Specifically, FIG. 1 illustrates muffler pipes 101, 103, 105, 107, 109 and 111.

As illustrated by the muffler pipes in FIG. 1, the size and configuration of muffler pipes can vary widely. Some are substantially straight, while others have one or more bends. Some are stored with a muffler attached; others are not.

Most muffler pipes, such as those illustrated in FIG. 1, include a tubular portion attached at one end to a flange. In connection with muffler pipe 101, for example, a tubular portion 113 is attached at one end to a flange 115. Similarly, muffler pipe 103 includes a tubular portion 117 attached at one end to a flange 119; muffler pipe 105 includes a tubular portion 121 attached at one end to a flange 123; muffler pipe 107 includes a tubular portion 125 attached at one end to a flange 127; muffler pipe 109 includes a tubular portion 129 attached at one end to a flange 131; and muffler pipe 111 includes a tubular portion 133 attached at one end to a flange 135. Each of the flanges may be configured to be bolted to an engine manifold.

Figure 2:
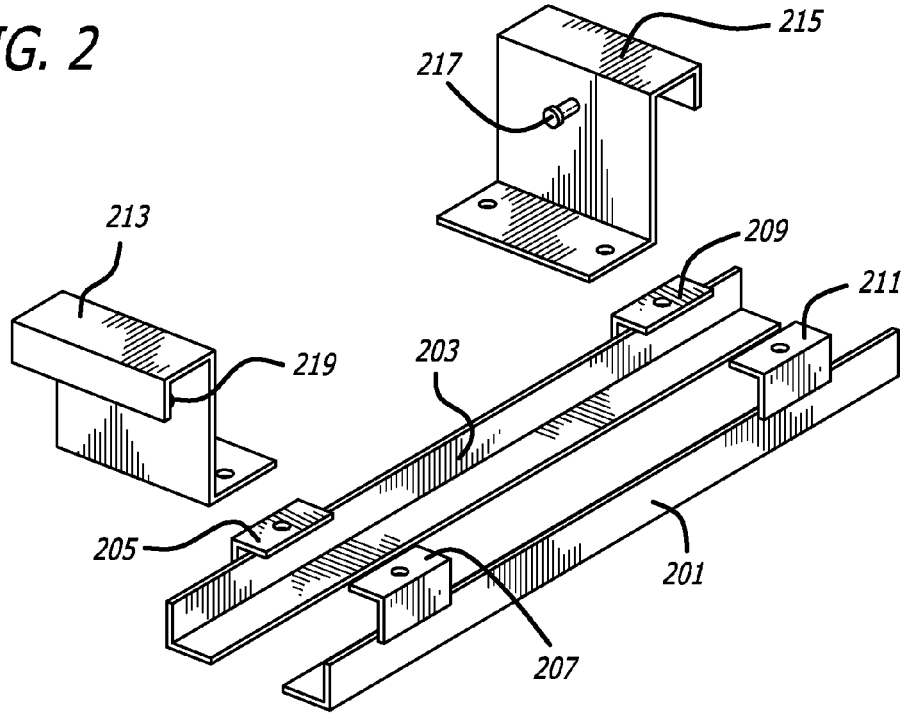
FIG. 2 illustrates an exploded view of components of a muffler pipe storage rack.

FIG. 2 illustrates an exploded view of components of a muffler pipe storage rack. The muffler pipe storage rack may include two elongated support members 201 and 203, attachment brackets 205, 207, 209 and 211, and mounting brackets 213 and 215.

The elongated support members 201 and 203 may be elongated L-shaped brackets, as illustrated in FIG. 2. The elongated L-shaped brackets may have a length that is at least equal to the combined width of the flanges on the muffler pipes that are to be stored by the muffler pipe storage rack.

The attachment brackets 205 and 209 may each be attached to an end of the elongated support member 203; and the attachment brackets 207 and 211 may be attached to an opposing end of the elongated support member 201. The attachment brackets 205, 207, 209 and 211 may be attached to their respective elongated support members 201 or 203 by any means, such as by welding, bolts and/or other means.

The mounting bracket 213 may be attached to the attachment brackets 205 and 207; and the mounting bracket 215 may be attached to the attachment brackets 209 and 211. Any means may be used to effectuate these attachments, such as welding, bolts and/or other means.

Each of the mounting brackets 213 and 215 may include an inverted U-shaped portion forming an open hook-like structure. The open hook-like structures may each be configured to clamp onto a substantially horizontal support and to thereby cause the elongated support member to which the mounting bracket is attached to be suspended from the substantially horizontal supports. The width of each U-shaped portion may be substantially the same as the width of the substantially horizontal support to which it is configured to be attached.

A releasable locking mechanism may be integrated with each mounting bracket, such as a set screw 217 that is integrated with the mounting bracket 215 and a set screw 219 that is integrated with the mounting bracket 213. The releasable locking mechanisms may be configured so as to allow the mounting bracket to be clamped onto the substantially horizontal support, slid horizontally to a desired position, and then locked in that position. When set screws are used, such as the set screws 217 and 219, the set screws may be substantially withdrawn from the U-shaped interior of the mounting bracket during installation, and then rotated until the head of the set screw firmly engages the substantially horizontal support.

Figure 3:
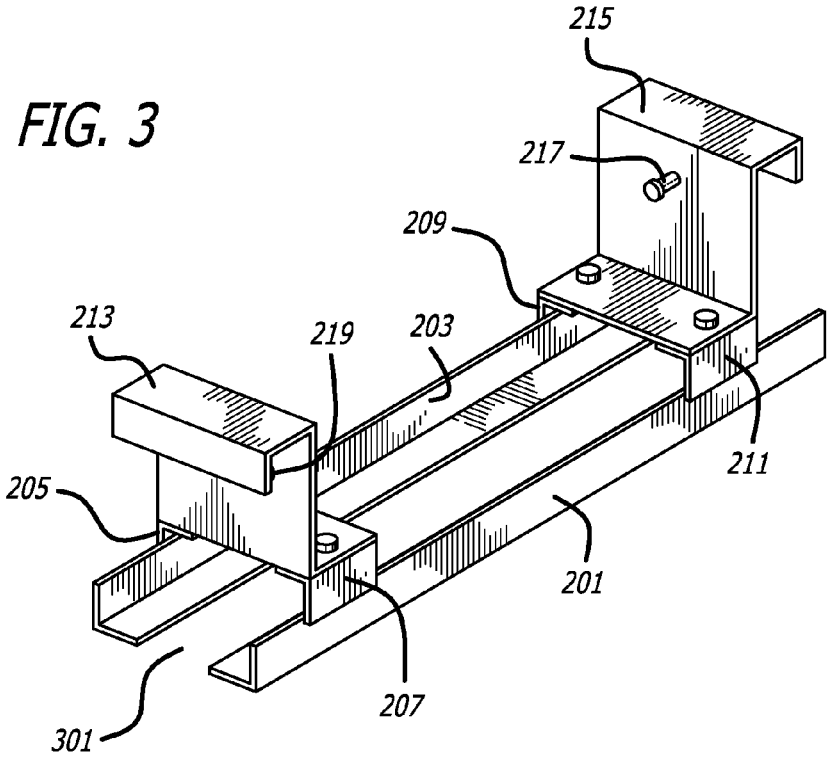
FIG. 3 illustrates the muffler pipe storage rack illustrated in FIG. 2 fully assembled.

FIG. 3 illustrates the muffler pipe storage rack illustrated in FIG. 2 fully assembled. As illustrated in FIG. 3, attachment of the mounting brackets 213 and 215 to the elongated support members 201 and 203 through the attachment brackets 205, 207, 209 and 211 may cause the elongated support members 201 and 203 to be substantially parallel and in a spaced-apart relationship. The spaced-apart and substantially parallel relationship between the elongated support member 201 and the elongated support member 203 may form a slot 301 that extends through one or both ends of the elongated support members 201 and 203. As also reflected in FIG. 3, the open hook-like structures of the inverted U-shaped portions of the mounting brackets 213 and 215 may each face outwardly, away from one another. In an alternate embodiment, they may each face in the same direction, or they may each face inwardly.

Figure 4:
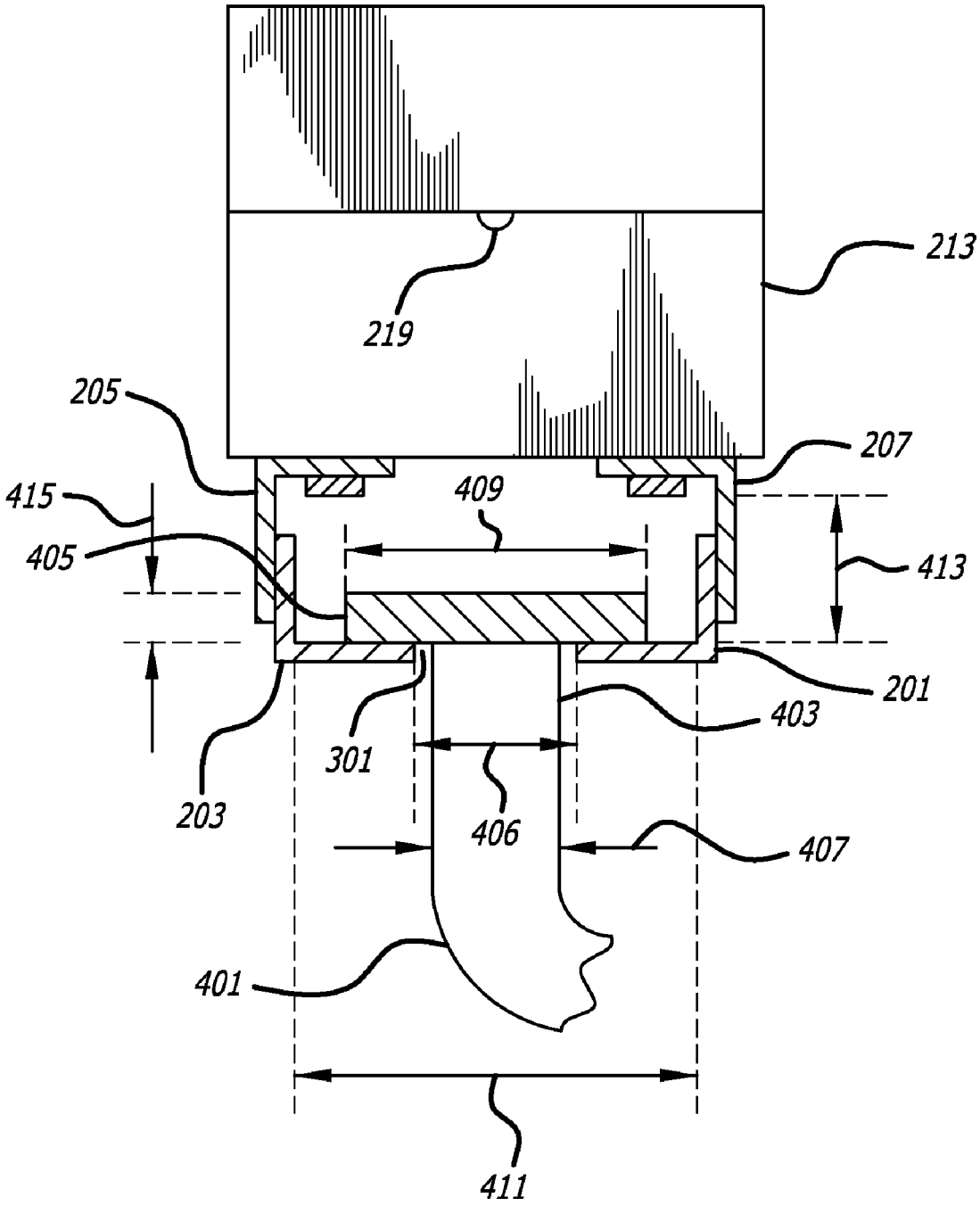
FIG. 4 is an end view of the muffler pipe storage rack illustrated in FIG. 3 with a muffler pipe resting within it.

FIG. 4 is an end view of the muffler pipe storage rack illustrated in FIG. 3 with a muffler pipe resting within it. As shown in FIG. 4, a muffler pipe 401 that includes a tubular portion 403 and a flange 405 attached at one end has been inserted into the slot 301 formed by the substantially parallel and spaced-apart elongated support members 201 and 203. As illustrated in FIG. 4, the slot 301 may have a width 406 that is at least as wide as the width 407 of the tubular portion 403. In the event that several muffler pipes are to be hung from the same muffler pipe storage rack, the width 406 of the slot 301 may be at least as wide as the width of the widest tubular portion in the set.

The width 406 of the slot 301 may also be less than the width 409 of the flange 405. In the event that several muffler pipes are to be hung from the muffler pipe storage rack, the width 406 of the slot 301 may be less than the narrowest width of the flanges in the set.

The clearance above the slot 301 throughout the entire length of the slot may have a width 411 that is at least as wide as the width 409 of the flange 405. In the event that several muffler pipes are to be hung from the muffler pipe storage rack, the width 411 of the clearance above the slot may be at least as wide as the width of the widest flange in the set.

The clearance above the entire length of the slot 301 may have a height 413 that is at least as tall as the thickness 415 of the flange 405. In the event that several muffler pipes are to be hung from the muffler pipe storage rack, the height 413 of the clearance above the slot may be at least as tall as the thickness of the thickest flange in the set.

Figure 5:
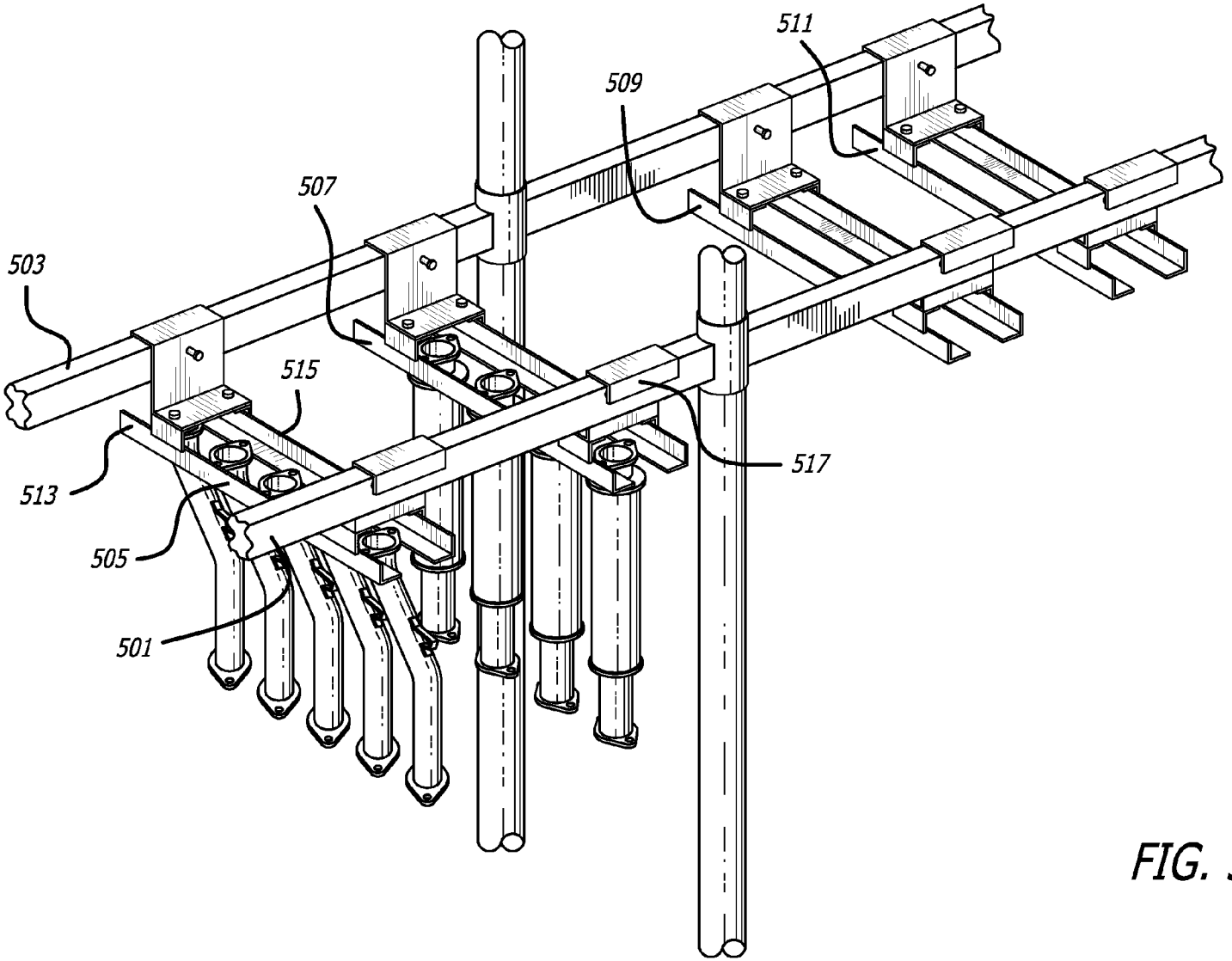
FIG. 5 illustrates several muffler pipe storage racks of the type illustrated in FIG. 3 clamped to a pallet storage rack with muffler pipes hanging from them.

FIG. 5 illustrates several muffler pipe storage racks of the type illustrated in FIG. 3 clamped to a pallet storage rack with muffler pipes hanging from them. As shown in FIG. 5, a pallet storage rack may include two substantially parallel and substantially horizontal supports 501 and 503. Several muffler pipe storage racks of the type illustrated in FIG. 3 may be clamped to the supports 501 and 503, such as muffler pipe storage racks 505, 507, 509 and 511. Each of the muffler pipe storage racks may be oriented so as to traverse the supports 501 and 503. The two elongated support members that are included within each of the muffler pipe storage racks, such as elongated support members 513 and 515, may have a length that exceeds the spacing between the supports 501 and 503. This longer length in cooperation with the position of the mounting brackets on the muffler pipe storage rack, such as the mounting bracket 517, may allow the muffler pipe storage rack when not locked to move horizontally across the supports 501 and 503, but not to be completely removable therefrom without disassembly. The two elongated support members 513 and 515 may instead have a length that is less than the spacing between the supports 501 and 503, thus allowing the muffler pipe storage rack to be completely detached from the pallet without disassembly.

Figure 6:
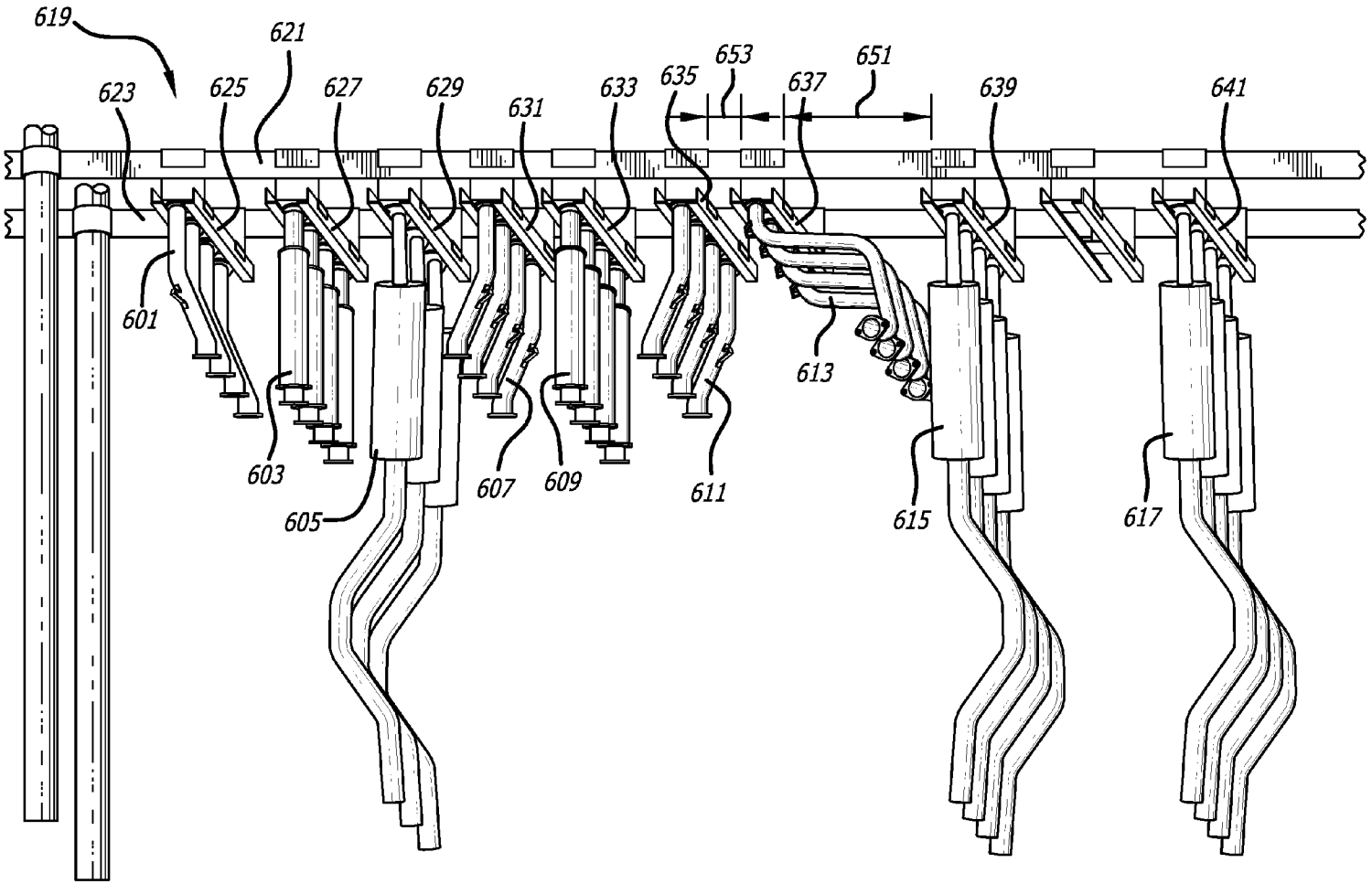
FIG. 6 illustrates muffler pipes of different sizes and configurations hanging from a pallet storage rack to which several muffler pipe storage racks of the type illustrated in FIG. 3 are clamped.

FIG. 6 illustrates muffler pipes of different sizes and configurations hanging from a pallet storage rack to which several muffler pipe storage racks of the type illustrate in FIG. 3 are clamped. As shown in FIG. 6, muffler pipes of different sizes and configurations, such as muffler pipes 601, 603, 605, 607, 609, 611, 613, 615 and 617, are hanging from a pallet storage rack 619 having substantially horizontal and substantially parallel support members 621 and 623, to which are clamped several muffler pipe storage racks of the type illustrated in FIG. 3, such as muffler pipe storage racks 625, 627, 629, 631, 633, 635, 637, 639 and 641. As also illustrated in FIG. 6, the muffler pipes that are hung on the same muffler pipe storage rack may be of the same size and configuration.

Any method may be used for determining the position of each of the muffler pipe storage racks 625, 627, 629, 631, 633, 635, 637, 639 and 641 with respect to the support members 621 and 623. For example, they may be horizontally positioned so as to allow the muffler pipes that are or will be hung from them to hang freely without touching neighboring muffler pipes, while at the same time minimizing the open space between neighboring, hanging muffler pipes. When muffler pipes having different hanging widths are used, this may result in unequal spacing between neighboring muffler pipe storage racks. For example, the spacing 651 between the muffler pipe storage racks 627 and 629 may be greater than the spacing 653 between the neighboring muffler pipe storage racks 629 and 631.

To use the muffler pipe hanging system illustrated in FIG. 6, a particular muffler pipe that is to be hung may be oriented so that its tubular portion is substantially vertical with its flange at top. The flange may then be positioned in front of and slightly above the slot in a particular muffler pipe storage rack and then slid horizontally until the tubular portion is are completely within the slot and the flange is completely above the slot. The flange of the muffler pipe may then be allowed to engage the top surface of the slot by releasing the muffler pipe while it is in the slot. The muffler pipe may then be left to conveniently hang in this position.

When needed, the reverse process may be followed. The desired muffler pipe may be grabbed and slid horizontally until its tubular portion is completely withdrawn from the slot and until no portion of the flange is any longer above the slot. The desired muffler pipe may then be separated from the muffler pipe hanger system and transported to where it is needed.

The components, steps, features, objects, benefits and advantages that have been discussed are merely illustrative. None of them, nor the discussions relating to them, are intended to limit the scope of protection in any way. Numerous other embodiments are also contemplated, including embodiments that have fewer, additional, and/or different components, steps, features, objects, benefits and advantages. The components and steps may also be arranged and ordered differently.

The phrase "means for" when used in a claim embraces the corresponding structures and materials that have been described and their equivalents. Similarly, the phrase "step for" when used in a claim embraces the corresponding acts that have been described and their equivalents. The absence of these phrases means that the claim is not limited to any of the corresponding structures, materials, or acts or to their equivalents.

Nothing that has been stated or illustrated is intended to cause a dedication of any component, step, feature, object, benefit, advantage, or equivalent to the public, regardless of whether it is recited in the claims.

In short, the scope of protection is limited solely by the claims that now follow. That scope is intended to be as broad as is reasonably consistent with the language that is used in the claims and to encompass all structural and functional equivalents.

We claim:

1. A system of stored muffler pipes comprising:

a plurality of substantially-identical muffler pipes, each muffler pipe including an elongated tubular portion having a length and a width and a flange attached to one end of the tubular portion that is configured to be bolted to a portion of an exhaust system and that has a width that is wider than the width of the tubular portion:

an elongated support member having two ends and a longitudinal slot between the two ends, the longitudinal slot having:

a width that is wider than the width of the tubular portion, but narrower than the width of the flange; and a length that is at least as long as the sum of the widths of the flanges;

a first mounting bracket affixed near to but offset from one end of the elongated support member and configured to clamp to a first substantially horizontal support and to suspend the one end of the elongated support member from the first substantially horizontal support; and a second mounting bracket affixed near the other end of the elongated support member and configured to clamp to a second substantially horizontal support substantially parallel to the first substantially horizontal support and to suspend the other end of the elongated support member from the second substantially horizontal support, wherein the longitudinal slot in the elongated support member forms an entry channel into which the tubular portion of each muffler pipe may be inserted, the entry channel being free of obstructions above the entry channel, thereby permitting the tubular portion of each muffler pipe to be inserted completely within the entry channel at any location along the length of the elongated tubular portion, and wherein each muffler pipe is hanging on the elongated support member by its flange with the tubular portion within the longitudinal slot of the elongated support member.

2. The system of stored muffler pipes of claim 1 wherein:

the first mounting bracket includes an inverted U-shaped portion having an interior width that is substantially the same as the width of the first substantially horizontal support; and the second mounting bracket includes an inverted U-shaped portion having an interior width that is substantially the same as the width of the second substantially horizontal support.

3. The system of stored muffler pipes of claim 2 wherein each of the inverted U-shaped portions form an open hook-like structure and wherein each of the open-hook like structures are facing outwardly from the elongated support member.

4. The system of stored muffler pipes of claim 1 wherein:

the first mounting bracket includes a first releasable locking mechanism configured to releasably lock the first mounting bracket to the first substantially horizontal member; and the second mounting bracket includes a second releasable locking mechanism configured to releasably lock the second mounting bracket to the second substantially horizontal member.

5. The system of stored muffler pipes of claim 4 wherein the first and the second locking mechanism each include a set screw.

6. The system of stored muffler pipes of claim 1 wherein the elongated support member includes two elongated L-shaped members held in a spaced-apart and substantially parallel relationship by the first mounting bracket and the second mounting bracket.

7. The system of stored muffler pipes of claim 1 wherein there is a clearance above the entire length of the slot that has a width that is at least as wide as the widest of the flanges.

8. The system of stored muffler pipes of claim 1 wherein there is a clearance above the entire length of the slot that has a height that is at least as tall as the thickest of the flanges.

9. The system of stored muffler pipes of claim 1 wherein the slot extends through at least one of the ends of the elongated support member.

10. The system of stored muffler pipes of claim 1 wherein the first mounting bracket is configured to suspend the elongated support member from the first substantially horizontal support such that the slot is not blocked by the first substantially horizontal support.

11. A system of stored muffler pipes comprising:

a plurality of sets of muffler pipes, each set of muffler pipes being substantially-identical, each muffler pipe including an elongated tubular portion having a length and a width and a flange attached to one end of the tubular portion that is configured to be bolted to a portion of an exhaust system and that has a width that is wider than the width of the tubular portion:

a pallet storage rack having two substantially horizontal supports substantially parallel to one another; and a plurality of substantially parallel and spaced apart elongated support members, one for each set of muffler pipes, each attached transversely to the two substantially horizontal supports and having two ends and a longitudinal slot between the two ends, the longitudinal slot having:

a width that is wider than the width of the tubular portions of the set of muffler pipes that are for the elongated support member, but narrower than the width of the flanges of the set of muffler pipes that are for the elongated support member; and a length that is at least as long as the sum of the widths of the flanges of the set of muffler pipes that are for the elongated support member;

wherein the longitudinal slot in the elongated support member forms an entry channel into which the tubular portion of each muffler pipe may be inserted, the entry channel being free of obstructions above the entry channel, thereby permitting the tubular portion of each muffler pipe to be inserted completely within the entry channel at any location along the length of the elongated tubular portion, and wherein each muffler pipe is hanging on one of the elongated supports by its flange with the tubular portion within the longitudinal slot of the elongated support member.

12. The system of stored muffler pipes of claim 11 wherein the plurality of elongated support members include a first, second, and third sequentially-positioned elongated support member, the first and second of which are spaced apart by an amount that is different than the spacing between the second and the third.

13. The system of stored muffler pipes of claim 12 wherein each of the elongated support members are releasably attached to the horizontal supports.

14. The system of stored muffler pipes of claim 13 further including a set screw in each of the elongated support members oriented to effectuate the releasable attachment.

15. A system of stored muffler pipes comprising:

a plurality of substantially-identical muffler pipes, each muffler pipe including an elongated tubular portion having a length and a width and a flange attached to one end of the tubular portion that is configured to be bolted to a portion of an exhaust system and that has a width that is wider than the width of the tubular portion:

an elongated support member having two ends and a longitudinal slot between the two ends, the longitudinal slot having:

a width that is wider than the width of the tubular portion, but narrower than the width of the flange; and a length that is at least as long as the sum of the widths of the flanges; and a support supporting the elongated support in an elevated position, wherein each muffler pipe is hanging on the elongated support member by its flange with the tubular portion within the longitudinal slot of the elongated support member.

* * * * *